United States Patent [19]

Dantzer et al.

[11] 4,048,766

[45] Sept. 20, 1977

[54] CLOSURE LID ASSEMBLY FOR PROTECTIVE HOUSINGS

[75] Inventors: Peter H. Dantzer, Richardson; Charles L. Tatay, Dallas, both of Tex.

[73] Assignee: Intercontinental Plastics Mfg. Co., Dallas, Tex.

[21] Appl. No.: 610,266

[22] Filed: Sept. 4, 1975

[51] Int. Cl.[2] ..... E02D 29/10

[52] U.S. Cl. ..... 52/19; 49/465; 137/364; 220/74; 220/328

[58] Field of Search ..... 137/371, 364; 404/25, 404/26; 52/19–21; 49/463, 465; 220/327, 328, 74; 174/37

[56] References Cited

U.S. PATENT DOCUMENTS

| | | | |
|---|---|---|---|
| 314,781 | 3/1885 | Beckwith | 404/25 |
| 689,224 | 12/1901 | Pillsbury | 404/26 |
| 1,131,327 | 3/1915 | Caldwell | 49/463 X |
| 1,177,850 | 4/1916 | Dougherty | 49/463 X |
| 1,277,373 | 9/1918 | Bugbie | 137/371 |
| 1,447,256 | 3/1923 | Lincoln | 404/26 |
| 2,113,713 | 4/1938 | Slocum | 49/465 |
| 3,392,867 | 7/1968 | Morris | 174/37 |
| 3,611,889 | 10/1971 | Levinson | 404/26 X |
| 3,717,963 | 2/1973 | Sauriol | 404/25 X |
| 3,920,347 | 11/1975 | Sauriol et al. | 404/25 |
| 3,921,449 | 11/1975 | Hauffe et al. | 137/371 |

FOREIGN PATENT DOCUMENTS

| | | | |
|---|---|---|---|
| 725,408 | 1/1966 | Canada | 52/20 |

*Primary Examiner*—Leslie Braun
*Attorney, Agent, or Firm*—Kenneth R. Glaser

[57] ABSTRACT

Disclosed is a lid assembly having a lid support and cooperating lid constructed of structural foam molded synthetic polymeric material, the lid support including a base portion adapted for nontranslatable removable engagement with various diameter protective housings and having an upstanding wall portion defining a surface access opening, the closure lid having a construction adapted to fit within and close off the surface access opening. The lid support includes a plurality of circumferentially extending reinforcing ribs, selected ones of which are flat and thus define stacking ledges; and the lid includes a network of transversely intersecting ribs providing the principal structural support for the lid.

1 Claim, 3 Drawing Figures

Figure 1:
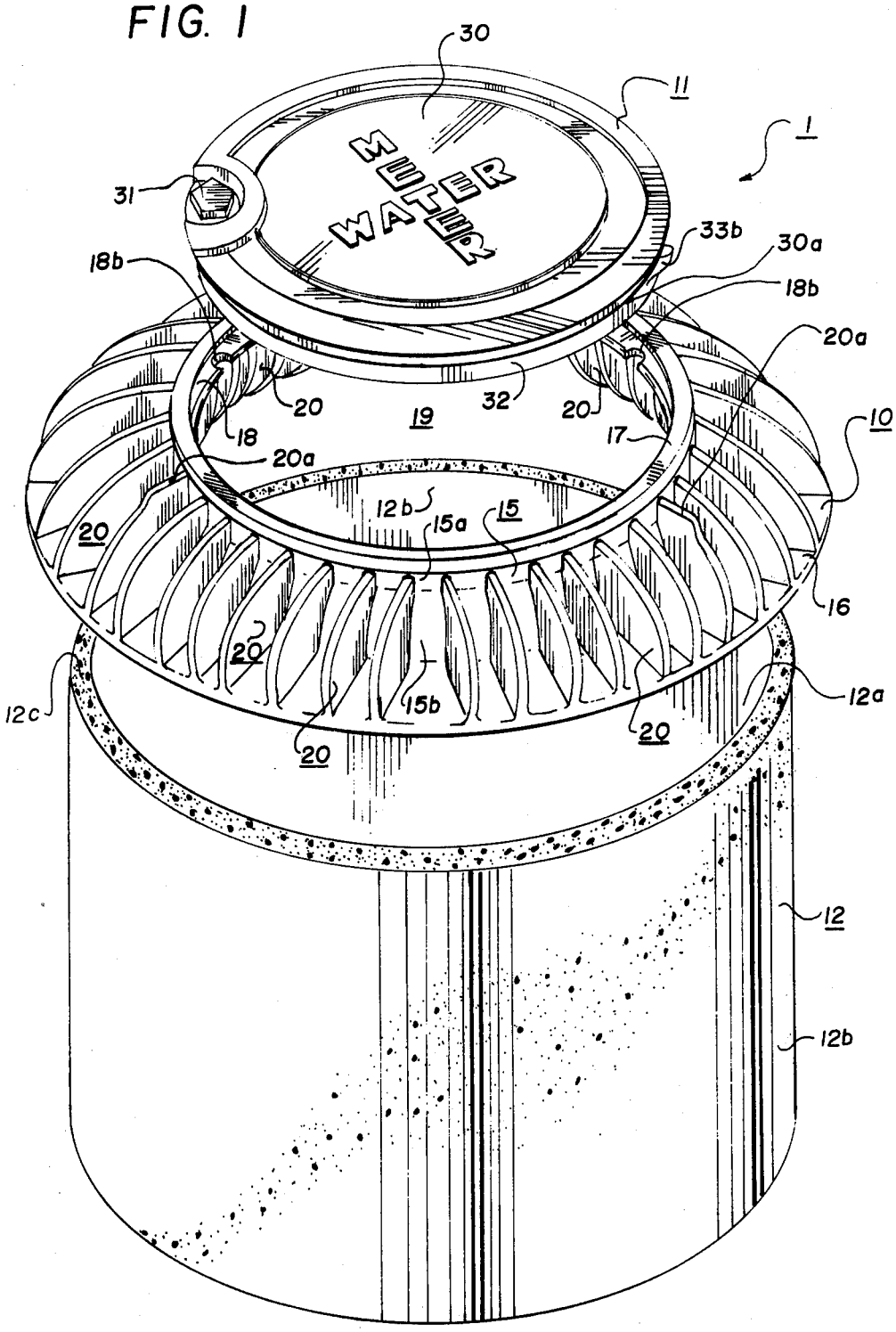

FIG. 2
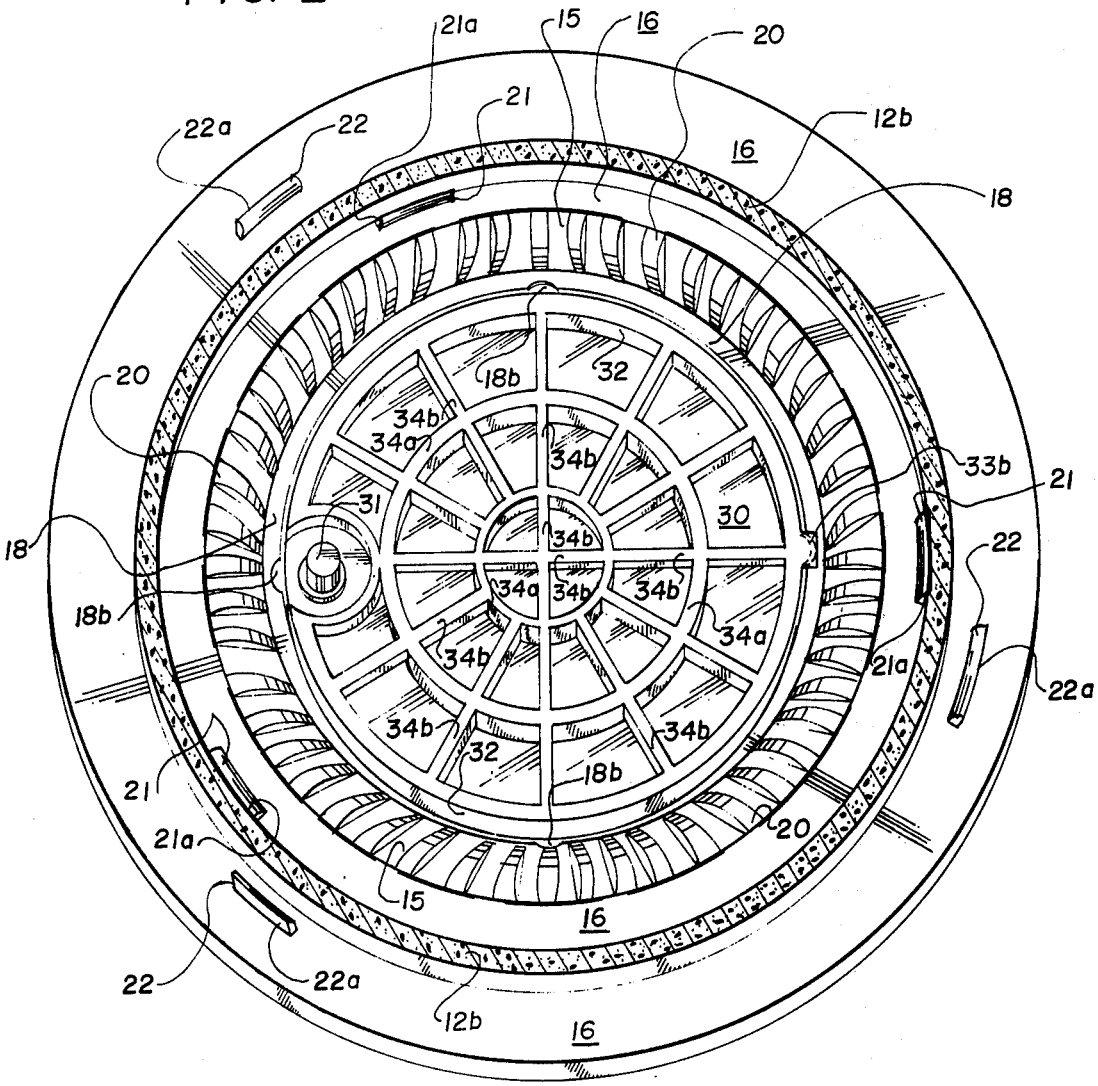
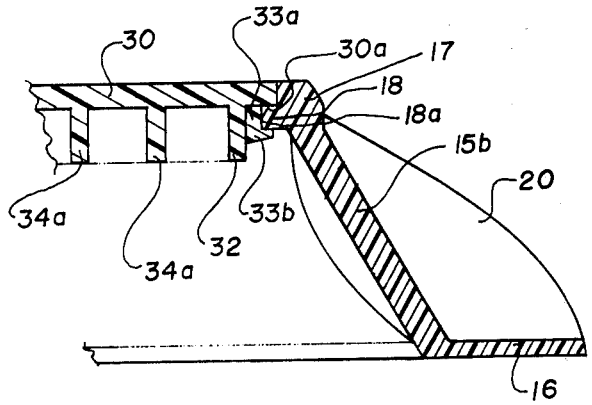
FIG. 3

CLOSURE LID ASSEMBLY FOR PROTECTIVE HOUSINGS

The present invention relates to protective housings for water meters, fluid conduits, and the like, more particularly to protective housings for underground installed apparatus, and even more particularly to an improved closure lid assembly for such housings.

As is well known, apparatus such as water meters, fluid conduits, and the like need to be protected or isolated from their environment, particularly when the apparatus would be subjected to freezing or subfreezing temperatures. As a consequence, it has been customary to surround this apparatus with a cylindrical pipe or housing which, when the apparatus is underground, is buried to a substantial depth within the ground surrounding the underground installations, the ground level opening to these housings then being sealed or closed off by appropriate closure assemblies which enable convenient access therethrough to the water meters, pipes, etc. Typically, the closure lid assemblies have been formed of a material, for example cast iron, which results in a final structure which is not only difficult to handle due to its bulkiness and weight, but also allows excessive heat loss from the housing through the closure assembly.

It is therefore a principal object of the invention to provide a new and improved closure lid assembly for protective housings enclosing water meters, fluid conduits, and the like.

It is another object of the present invention to provide a new and improved closure lid assembly for housings protecting underground installed apparatus.

It is another object of the present invention to provide a new and improved design of a closure lid assembly for underground installed protective housings wherein said closure lid assembly is of a plastic or synthetic polymeric material construction which not only possesses improved strength characteristics and is generally lightweight and convenient to handle, but also reduces the heat loss therethrough.

It is an even further object of the present invention to provide a new and improved closure lid assembly comprising a cooperating closure support and lid closure having improved structural features and functional advantages over those closure lid assemblies presently known in the art.

In accordance with these and other objects, the present invention is directed to a closure lid assembly comprising a closure support means adapted for removable and nontranslatable connection with various diameter housings of the type protecting apparatus, normally underground installations, and a closure means for retention within the surface access opening defined by the closure support means. Both the lid closure and the closure support are constructed of a light-weight synthetic polymeric material and are preferably formed by a structural foam molding process. The closure support includes a plurality of circumferentially disposed reinforcing ribs integrally joining the respective portions of the support; and the closure lid includes a network of transversely intersecting ribs providing the principal structural support therefor.

Additional features, objects, and advantages of the present invention can be more readily ascertained from the following detailed description thereof taken in conjunction with the accompanying drawings, wherein:

FIG. 1 is an overhead exploded pictorial view of a protective housing and the lid assembly of the present invention for closing off such housing;

FIG. 2 is an underside view of the assembly depicted in FIG. 1 illustrating the interconnection and interrelationship between the protective housing, the closure lid support, and the closure lid, a portion of the vertically extending enclosing wall portion of the protective housing being removed for convenient viewing of the underside of the assembly; and FIG. 3 is a partial sectional view illustrating the interconnection of the lid and lid support, particularly at the situs where the lid is restrained against rotation.

Referring now to FIG. 1, the lid assembly of the present invention is generally designated by the reference numeral 1, includes lid support 10 and lid 11, and is adapted to close off the top entranceway **12*a* of an elongated hollow cylindrical housing 12. The housing 12 is typical of those tubular shaped enclosures which are ordinarily, but not necessarily, installed or buried in the ground (in the upright position depicted in the drawing) and which are disposed around, and serve to protect from the environment, underground installations such as water and utility meters, fluid conduits, and the like. These protective housings are particularly suited for those climates where the anticipated temperatures are at or below the freezing range; and under such circumstances, the enclosing wall portion 12*b*** surrounding the underground installations normally vertically extends to a depth below the ground surface in excess of two feet, the housing conventionally formed of corrugated metal, fibrous board, concrete, or other suitable materials.

The lid support 10 is adapted for removable connection with the protective housing 12 and includes a circular, laterally extending base portion 16 of a size and shape to be supported upon the top surface **12*c* of the enclosing wall portion 12*b* of the housing. Extending from the bottom surface of the base 16 (FIG. 2) are one or more sets of lugs (two such sets 21 and 22 being depicted in the drawing) having outer flat faces 21*a* (and 22*a*) adapted to engage the interior surface of wall 12*b* when the lid support 10 is mounted in place, thereby preventing lateral movement between the housing 12 and lid support 10. Since each set of lugs is circumferentially disposed around the base and spaced from the center thereof at respectively different distances, the lid support 10 is adapted for removable, but nontranslatable connection with protective housings having various diameters. For example, and as may be apparent, the set of lugs 21 engage the interior surface of the enclosing wall of a protective housing of one diameter, while the set of lugs 22 are adapted to engage the interior wall portion of a protective housing of greater diameter. It is apparent that three or more sets of lugs may also be provided for the same purpose, it only being necessary that there be sufficient clearance between adjacent sets of lugs to enable passage of the wall portion 12*b***.

Integrally joined with the base 16 is an annular side wall 15 having a top portion **15*a* and an adjacent lower portion 15*b* inclined outwardly therefrom toward the base 16. Integral with the top portion 15*a* of side wall 15 is an annular ring portion 17 with a flange 18 recessed from the top surface thereof and defining top opening 19 in the support 10, the opening 19 enabling access to the interior of the housing 12 when the lid support 10 is in place. As subsequently described in greater detail, the ring portion 17 (and recessed flange 18) are of a size and shape adapted to receive the lid 10 for closing off opening 19.**

Circumferentially disposed around the lid support 10 are a plurality of reinforcing ribs 20 which integrally join the base 16, side wall 15, and ring portion 17, the ribs extending through the annular side wall 15 into the interior opening of the lid support. Selected ones of the ribs 20 have flat top surface portions 20*a,* which, in accordance with a unique feature of the present invention, essentially provide stacking ledges upon which the bottom surface of the base portion 16 of each lid support can rest. Thus, each of the lid supports 10, when not in use, can be stacked upon one another for storage and shipping purposes.

As previously described, the lid support 10 supportably receives lid 11 for closing off opening 19. Specifically, the lid 11 includes a generally disc or plate shaped top portion 30 with identifying indicia such as the manufacturer's name, identification of the type of installation within the housing 12, and other descriptive material normally appearing on the top surface thereof. Extending through the plate 30 is a key engaging lug 31 which engages a suitable locking mechanism (not shown) to prevent theft of the cover and unauthorized access to the interior of the housing. As is conventionally known, the exposed gripping surface of lug 31 is adapted to be engaged by an appropriate key for operating the locking mechanism.

Extending downwardly from the bottom of the plate 30 is an outer ring 32. As best depicted in FIG. 3, the ring 32 is recessed from the outer circumference of the plate 30 so that a ledge 30*a* is defined at the underside of, and extending around the outer circumference of, the top 30. The lid 10 is of a size and shape so that when it is received within the opening 19 of the support 10, the top 30 is disposed within the confines of, and has its top surface preferably flush with the top of, ring 17. Thus, the ring 17 essentially protects the lid from damage that may occur if the lid was not flush and therefore fully exposed. The ledge 30*a* rests upon the recessed flange 18 of the lid support, the size and diameter of the ring 32 being such that it extends through the opening 19 within the confines of the inner surface 18*a* of the flange 18.

To assist in retaining the lid within the opening 19, retaining means including a vertically extending projection 33*a* and flange 33*b* is formed at one location at the outer surface of ring 32 so that when the lid is in place, the projection 33*a* is retainably received within one of a plurality of notches 18*b* formed in annular flange 18 (thus restraining the lid against rotation), the flange 33*b* disposed against the underside of flange 18 (as best depicted in FIG. 3).

Both the lid 10 and lid support 11 are constructed of a light-weight synthetic polymeric material, preferably high density polyethylene. In addition, and to provide the principal structural support therefor, the lid 11 includes a network of transversely intersecting ribs at its underside integrally joining the annular ring 32 and top plate 30. Specifically, the network includes a first plurality of annular ribs 34*a* concentrically disposed with respect to one another and with respect to the ring 32 and a second plurality of elongated ribs 34*b* radiating outward from the center of the cover and transversely intersecting the first set of ribs 34*a* as well as ring 32.

In accordance with a unique feature of the present invention, both the lid and lid support are fabricated by a process, for example the structural foam molding process described in U.S. Pat. Nos. 3,268,636 and 3,436,446, which results in the final structure having a high density surface zone or shell and an integrally formed, lower density cellular interior. It has been found that the interior cellular construction results in the lid assembly, and particularly the lid itself, having heat insulating properties far in excess of that characteristic of conventional cast iron lids, the decreased heat conductivity thereby substantially reducing the heat loss from the interior of the housing 12. Thus, the lid and overall lid assembly of the present invention is particularly and uniquely suited for those applications where the underground installations must be protected from a frigid environment.

In practice, the housing 12 is buried within the ground to surround and protect the specific underground installation. The lid support 10 is thereafter retainably disposed upon the top of the housing and is normally buried to a depth where only the ring portion 17 is exposed at the surface. Thus, the opening 19 essentially provides the normal surface access to the interior of the housing, the lid 11 providing a convenient means for closing off or uncovering this opening. Under circumstances which would require workmen to enter the enclosure 12, the lid support 10 can be unburied and easily removed from the housing, thus providing such access.

Various modifications of the disclosed embodiment, as well as other embodiments of the invention, may become apparent to those skilled in the art without departing from the spirit and scope of the invention as defined by the appended claims.

What is claimed is:

1. A two part closure assembly for closing off the surface access opening to a plurality of cylindrically shaped housings having peripheral walls of respectively different radii, the housings being of the type disposed around, and employed to protect, underground installations, said two part closure assembly comprising:

a. a closure support means of synthetic polymeric material construction and adapted for removable, but non-translatable, coupling with each of said cylindrically shaped housings, said closure support means comprising a circular, laterally extending base portion; an annular side wall integrally joined with, and inclined with respect to, said base portion; an annular ring portion integrally joined with said side wall and having a flange vertically recessed therefrom to define a support ledge, said annular side wall and ring portion displaced inwardly from the outer periphery of said base portion; a plurality of arcuately shaped ribs circumferentially disposed around the base portion and integrally formed with said base portion, side wall and ring portion; said ribs continuously extending from a location outside of, to a location inside, said annular side wall; a plurality of sets of circumferentially disposed lugs extending from the bottom surface of said base portion, each of said sets located at respectivey different radii along said base portion and corresponding to the radii of the peripheral walls of said cylindrically shaped housings, each of said lugs having surfaces adapted for non-translatable engagement with the peripheral wall of said housings; and a plurality of curcumferentially spaced notches in said flange; and b. closure means of synthetic polymeric material removably coupled with said closure support means and closing off said surface access opening, said closure means supported by said support ledge and comprising projection means retainably received within one of said spaced notches.

* * * * *